US005855029A

United States Patent [19]

Flippen, Sr.

[11] Patent Number: 5,855,029

[45] Date of Patent: Jan. 5, 1999

[54] COMPACT WATER-SAVING MODULAR BATHROOM FIXTURE

[76] Inventor: Robert A. Flippen, Sr., 6919 Dan St., Richmond, Va. 23231

[21] Appl. No.: 954,258

[22] Filed: Oct. 20, 1997

[51] Int. Cl.[6] ..... A47K 4/00

[52] U.S. Cl. ..... 4/664; 4/665

[58] Field of Search ..... 4/664, 665, 340, 4/301, 310

[56] References Cited

U.S. PATENT DOCUMENTS

| | | | |
|---|---|---|---|
| 2,324,725 | 7/1943 | Rich | 4/665 |
| 2,595,009 | 4/1952 | Sillen | 4/665 |
| 2,860,348 | 11/1958 | McClenahan | 4/665 |

FOREIGN PATENT DOCUMENTS

| | | | |
|---|---|---|---|
| 5-202547 | 8/1993 | Japan | 4/665 |

*Primary Examiner*—David J. Walczak
*Attorney, Agent, or Firm*—Norman B. Rainer

[57] ABSTRACT

A modular bathroom fixture of compact size and serving as a urinal and hand-washing basin, includes a flat rear panel adapted to permit wall-mounting, forwardly directed paired side panels, a horizontally disposed basin embraced by the side panels, and a urinal trough located below the basin. In operation, water from the basin drains by gravity flow into the urinal, thence downwardly again to a sewer discharge conduit.

3 Claims, 1 Drawing Sheet

COMPACT WATER-SAVING MODULAR BATHROOM FIXTURE

BACKGROUND OF THE INVENTION

1. Field of the Invention

This invention relates to bathroom equipment, and more particularly concerns modular apparatus of compact size incorporating a wash basin and a urinal.

2. Description of the Prior Art

In many commercial establishments such as restaurants, retail stores, automobile service stations and sports stadiums, bathroom facilities are provided for the convenience of the patrons of the establishment. Because such bathroom facilities occupy valuable floor space, it is desirable to minimize their space requirements. In the realm of public transportation such as airplanes, buses and trains, not only are space requirements critical, but the amount of water that must be carried to service the bathroom is also a significant matter.

Compact, space-saving bathroom equipment has been disclosed in U.S. Pat. Nos. 1,935,774 to Kemach; 3,015,827 to Iwata; 3,458,871 to Valcervo; 4,538,864 to Medrano; 4,653,128 to Canalizo; and 5,228,152 to Fraley. In addition to providing space-saving configurations, most of the devices of the aforesaid patents seek conservation of the use of water. However, such conservation is generally achieved by routing water by gravity flow from a wash basin to a toilet tank reservoir. It is also to be noted that, in securing the sought compact configuration and water-saving features, specialized constructions are required which are either costly or difficult to install.

It is accordingly an object of the present invention to provide a multi-functional bathroom fixture of compact construction.

It is another object of this invention to provide a bathroom fixture as in the foregoing object which conserves the use of water.

It is a further object of the present invention to provide a fixture of the aforesaid nature which is easy to install into a small bathroom area.

It is yet another object of this invention to provide a fixture of the aforesaid nature which is of simple, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a bathroom fixture comprising:

a) a flat rear panel having means for mounting in vertical disposition upon a wall surface, and defined by upper, lower and paired side extremities, and back and forward surfaces, b) paired parallel side panels forwardly emergent from said side extremities, c) a horizontally disposed basin embraced by said rear and side panels, and first exit drain means for permitting downward flow of water away from said basin, said basin bounded in part by a bottom panel downwardly sloped toward said first drain means, and d) a trough horizontally disposed below said basin and positioned to receive water by gravity flow from said basin, said trough having a lower panel downwardly sloped toward a second drain means which permits downward emergence of water.

In preferred embodiments, the basin is equipped with a retaining sidewall which enables said basin to hold a predetermined volume of water. The rear panel is preferably provided with access apertures which permit the passage of inlet conduits for water.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
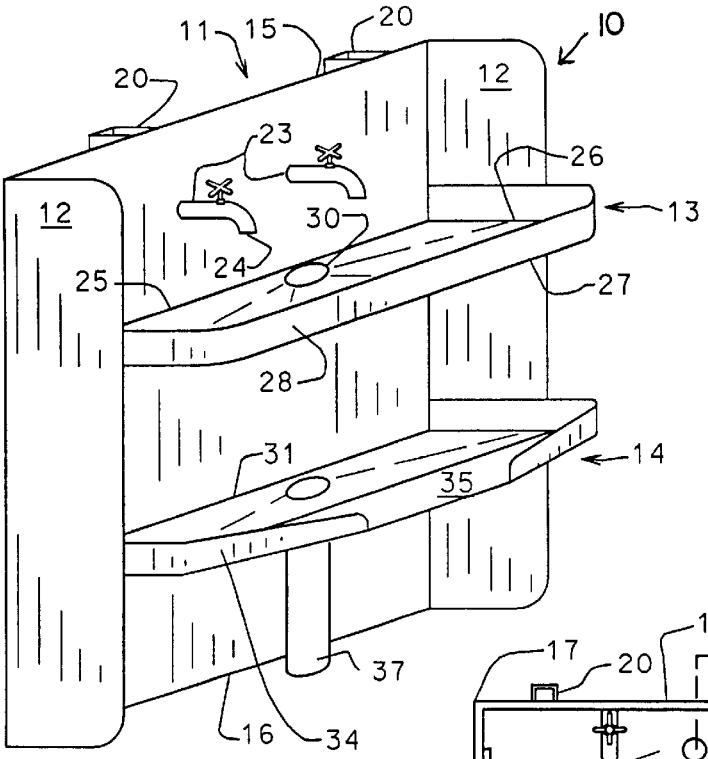
FIG. 1 is a perspective front and side view of an embodiment of the bathroom fixture of the present invention.
Figure 3:
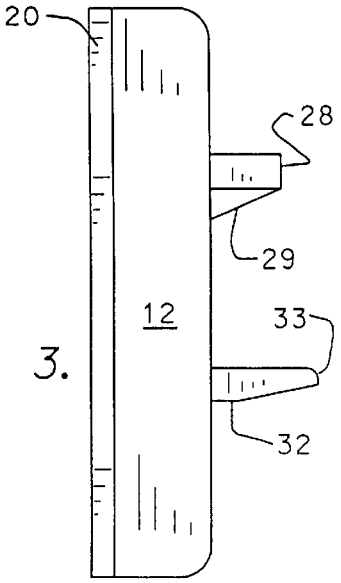
FIG. 3 is a side view.
Figure 4:
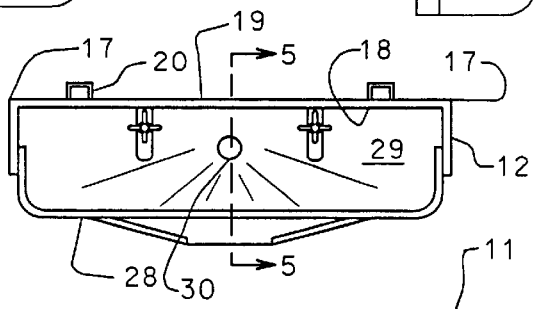
FIG. 4 is a top plan view.
Figure 2:
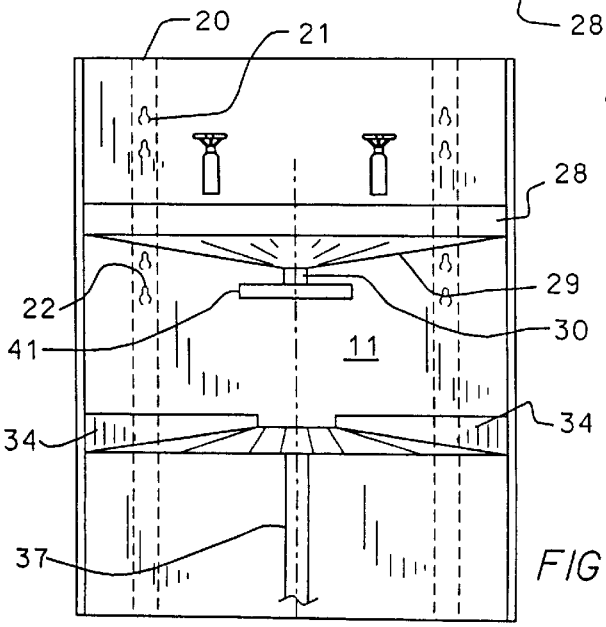
FIG. 2 is a front view of the embodiment of FIG. 1.
Figure 5:
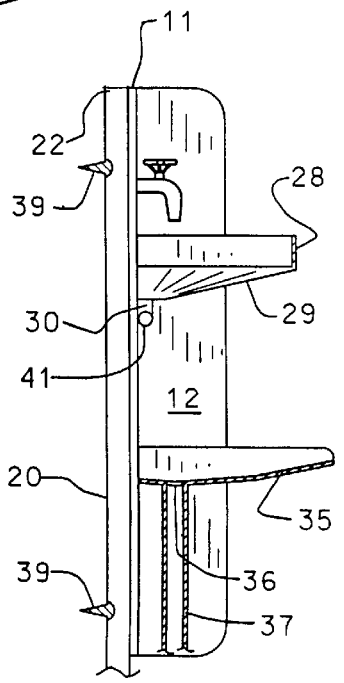
FIG. 5 is a sectional view taken in the direction of the arrows upon the line 5—5 of FIG. 4.

Referring now to FIGS. 1–5, an embodiment of the bathroom fixture 10 of the present invention is shown comprised of rear panel 11, side panels 12, basin 13 and trough 14.

Rear panel 11 is of flat rigid construction, as may be fabricated of sheet metal stock, or plastic material. Because corrosion resistance, durability and cleanability are important considerations, the sheet metal is preferably stainless steel. The illustrated embodiment of rear panel 11 is of substantially rectangular configuration, having upper and lower extremities 15 and 16, respectively, and opposed side extremities 17. Rear panel 11 may be further characterized in having forward and back surfaces 18 and 19, respectively. It is to be further noted that, in the illustrated, preferred embodiment, rear panel 11 is elongated upon an axis centered between said side extremities and extending between said top and bottom edges.

Mounting means in the form of paired brackets 20 are attached to the back surface 19 of said rear panel. Each bracket 20 is provided with a vertically aligned series of apertures 21, said apertures preferably being of keyhole configuration having narrowed upwardly directed portions 22. The dimensional features of brackets 20 and apertures 21 are such as to facilitate engagement with the heads of standard bolts 39 that may protrude from a wall surface. It is preferable that at least two bolts are utilized to engage each bracket.

Access apertures 23 are disposed in rear panel 11 for the purpose of accommodating the passage of water-conveying pipes that terminate in faucets 24. Rubber grommets may be secured within apertures 23 for the purpose of forming a secure and water impervious seal with water pipes penetrating said apertures.

Side panels 12 are forwardly emergent from side extremities 17 in parallel juxtaposition. Said side panels are preferably of identical size and shape, and are preferably continuous integral extensions of said rear panel, having been formed either by the bending of the sheet stock of rear panel 11, or in a plastic molding operation which simultaneously produces the rear panel and side panels.

Basin 13, horizontally disposed between side panels 12, is bounded in part by rear edge 25 attached to rear panel 11, side edges 26 attached to side panels 12, and forward edge 27 having upwardly directed retaining sidewall 28. Basin 13 is further comprised of bottom panel 29 which is downwardly sloped toward a first drain means in the form of circular aperture 30 positioned adjacent rear panel 11. The construction of said basin is such as to be water-tight. A removable stopper may be provided for aperture 30. The sloped contour of bottom panel 29 may be rounded or angular. The dimensions of said basin are such as to provide sufficient space and volume for the washing of the user's hands.

Trough 14, horizontally disposed between side panels 12, is bounded in part by rear edge 31 attached to rear panel 11, side edges 32 attached to side panels 12, and forward edge 33. Paired partial upwardly directed retaining sidewalls 34 may be associated with forward edge 33. Trough 14 is further comprised of bottom panel 35 which is downwardly sloped toward a second drain means in the form of aperture 36 positioned adjacent rear panel 11. Trough 14 functions as a urinal, namely to receive and dispose of the user's urine. Although the illustrated embodiment: of trough 14 is contoured for male use, it may also be contoured for female users.

In the operation of the fixture, water that is employed for hand washing purposes in basin 13 is discharged downwardly into trough 14 for the purpose of washing away urine. In some embodiments, distributor means in the form of a perforated tube 41 may lead from said first drain means to cause the descending water to evenly flow across the bottom panel 35 of said trough. The effluent from aperture 36 of trough 14 leads to a sewer discharge conduit 37.

The downwardly sloped configurations of the basin and trough may be produced either by the folding of sheet metal, or mold design when fabrication is with plastics. Other features may optionally be associated with the fixture of this invention, such features include for example, a paper towel dispenser, a soap dispenser, towel disposal receptacle and wall-mounted mirror.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A bathroom fixture comprising:

a) a flat rear panel having means for mounting in vertical disposition upon a wall surface, and defined by upper, lower and paired side extremities, and back and forward surfaces, said rear panel being elongated upon an axis centered between said side extremities and extending between said upper and lower extremities, b) paired parallel side panels forwardly emergent from said side extremities, c) a horizontally disposed basin embraced by said rear and side panels, and having first exit drain means for permitting downward flow of water away from said basin, said basin bounded in part by a bottom panel downwardly sloped toward said first drain means, and equipped with a retaining sidewall which enables said basin to hold a predetermined volume of water adequate for handwashing purposes, and d) a trough horizontally disposed below said basin and positioned to receive water by gravity flow from said basin, said trough having a lower panel downwardly sloped toward a second drain means which permits downward emergence of water.

2. The fixture of claim 1 wherein said rear panel is provided with access apertures which permit the passage of inlet conduits that carry water.

3. The fixture of claim 1 wherein distributor means are associated with said first exit drain means for causing water descending from said drain means to flow evenly across the lower panel of said trough.

* * * * *